US006454694B1

(12) United States Patent
Herman et al.

(10) Patent No.: US 6,454,694 B1
(45) Date of Patent: Sep. 24, 2002

(54) FREE JET CENTRIFUGE ROTOR WITH INTERNAL FLOW BYPASS

(75) Inventors: Peter K. Herman; Kevin South; Hendrik N. Amirkhanian, all of Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 09/939,160

(22) Filed: Aug. 24, 2001

(51) Int. Cl.[7] ..... B04B 9/06
(52) U.S. Cl. ..... 494/49
(58) Field of Search ..... 494/24, 36, 43, 494/49, 64, 65, 68, 70, 901; 210/168, 171, 232, 354, 360.1, 380.1, 416.5; 184/6.24

(56) References Cited

U.S. PATENT DOCUMENTS 3,784,092 A * 1/1974 Gibson
3,791,576 A 2/1974 Bazil
5,795,477 A * 8/1998 Herman et al.
5,906,733 A * 5/1999 Purvey
6,017,300 A * 1/2000 Herman
6,019,717 A * 2/2000 Herman

FOREIGN PATENT DOCUMENTS

| | | | |
|---|---|---|---|
| GB | 2 297 505 | | 8/1996 |
| JP | 50-11177 | * | 2/1975 |
| WO | 96/23589 | * | 8/1996 |

* cited by examiner

*Primary Examiner*—Charles E. Cooley
(74) *Attorney, Agent, or Firm*—Woodard, Emhardt, Naughton Moriarty & McNett

(57) ABSTRACT

A centrifuge includes a shaft and a center tube. The shaft has a single flow passage from which fluid is supplied and has one or more fluid ports defined therein. The center tube has two sets of openings defined therein. A portion of the fluid in the centrifuge is directed to bypass the cleaning operation and is directly used to drive the centrifuge. The remaining fluid flows through the centrifuge and particulate matter is removed from the liquid. The fluid is then discharged through the nozzles in order to rotate the centrifuge.

34 Claims, 11 Drawing Sheets

FREE JET CENTRIFUGE ROTOR WITH INTERNAL FLOW BYPASS

BACKGROUND OF THE INVENTION

The present invention generally relates to the continuous separation of solid particles, such as soot, from a fluid, such as oil, by use of a centrifuge. More specifically, but not exclusively, the present invention relates to a centrifuge that includes two separate fluid paths in which one of the fluid paths travels through a particulate collection zone of the centrifuge and the other path bypasses the particulate collection zone to directly drive the centrifuge through jet nozzles.

Diesel engines are designed with relatively sophisticated air and fuel filters (cleaners) in an effort to keep dirt and debris out of the engine. Even with these air and fuel cleaners, dirt and debris, including engine-generated wear debris will find a way into the lubricating oil of the engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try to address the concern over small particles, designers have gone to bypass filtering systems which filter a predefined percentage of the total oil flow. The combination of a full flow filter in conjunction with a bypass filter reduces engine wear to an acceptable level, but not to the desired level. Since bypass filters may be able to trap particles less than approximately 10 microns, the combination of a full flow filter and bypass filter offers substantial improvement over the use of only a full flow filter.

In high performance soot centrifuge (HPSC) designs, such as the one disclosed in U.S. Pat. No. 6,019,717 that was issued on Feb. 1, 2000 to Herman, which is incorporated by reference in its entirety, the inventors of the present invention have found that the collection rate of super-fine particulates, such as soot, increases by decreasing the flow rate passing through the rotor of the centrifuge. Traditional centrifuge theory predicts that reducing the flow rate in the rotor by half will result in a doubling of the single-pass collection efficiency of the centrifuge. Although the collection efficiency improves, since the flow rate is cut in half, the collection rate of particulates should remain unchanged. Graph 30, which is show in FIG. 1, graphically illustrates this predicted effect for super-fine particles, such as soot. As shown, graph 30 includes a flow rate axis 32 and a collection rate axis 33. Prediction line 35 in graph 30 illustrates the prediction that flow rate through the centrifuge has no effect on the collection rate. However, the inventors of the present invention have discovered that this theory does not appear to hold up in super-fine particulate regime where collection efficiencies are typically well under 0.5% on a single pass basis. As shown with actual line 36, the collection rate of the super-fine particles increases as the flow rate is decreased. It is theorized that the collection rate is improved at the lower flow rate though reduced re-entrainment of particulates in the fluid. The reduced flow rate diminishes fluid eddies and flow passing in close proximity to the collected particles (sludge) in the sludge collection zone of the centrifuge, which in turn reduces the amount of re-entrainment of the collected particles. The HPSC design allows for the freedom to reduce the rotor "through flow" rate without penalizing rotor speed. In the HPSC design, the fluid flow driving upon an external Pelton turbine is independent from the rotor flow rate so that the flow rates can be independently adjusted.

Unfortunately, in the lower cost and widely used hero-turbine centrifuge designs, (such as the ones disclosed in U.S. Pat. No. 5,795,477 that was issued on Aug. 18, 1998 to Herman et al. which is incorporated by reference in its entirety) simply reducing the rotor through flow to take advantage of this effect, does not work. In the hero-type centrifuges, a single flow path is used for both separation of particulates from the fluid and driving the centrifuge. Reducing the flow rate in the rotor reduces rotor speed because the rotation driving power is proportional to the rotor flow rate. One type of solution, such as disclosed in U.S. Pat. Nos. 3,784,092 and 5,906,733, is to provide two separate fluid sources, one for driving the centrifuge and the other for separation. However, using the two separate fluid sources in these designs increases the complexity and expense of the centrifuge. Furthermore, retrofitting such types of centrifuges to pre-existing systems is costly because additional piping needs to be installed.

While important strides have been made in this field, there still is room for improvement in the areas of particulate separation.

SUMMARY OF THE INVENTION

A centrifuge according to one embodiment of the present invention includes a rotor shell that defines an inner cavity. The rotor shell has a jet orifice defined therein that discharges fluid in order to rotate the rotor shell. A divider is provided in the inner cavity, which divides the inner cavity into a drive cavity and a separation cavity for collecting particulate matter from the fluid. The divider defines at least in part a divider passage between the separation cavity and the drive cavity, and the jet orifice open into the drive cavity. A tube extends within the inner cavity, and the tube has a fluid passage constructed and arranged to supply the fluid. The tube defines a separation opening at the separation cavity and a bypass opening at the drive cavity. The tube is constructed and arranged to deliver the fluid to the drive cavity through both a bypass flow path and a separation flow path. The bypass flow path includes the bypass opening. The separation flow path includes the separation opening, the separation cavity and the divider passage. The drive cavity is constructed and arranged to discharge the fluid received from both the bypass flow path and the separation flow path out the jet orifice.

A centrifuge according to another embodiment includes a shaft having a single fluid passage defined therein to supply fluid to the centrifuge. The shaft has one or more fluid ports defined therein that are in fluid communication with the fluid passage. A tube is provided around the shaft, and both the tube and the shaft define a tube passage that is in fluid communication with the fluid port. A rotor shell defines an inner cavity in which the tube is positioned. A divider plate is provided around the tube, and the divider plate divides the inner cavity into a drive cavity and a separation cavity. The divider plate defines a divider passage between the separation cavity and the drive cavity. The tube defines a separation opening in order to communicate the fluid between the tube passage and the separation cavity. The tube defines a bypass opening to communicate the fluid between the tube passage and the drive cavity. A baffle is positioned in the tube passage between the fluid ports and the separation opening. The baffle divides the tube passage into a separation portion and a bypass portion. The baffle is constructed and arranged to separate a separation flow path of the fluid from a bypass flow path of the fluid. The separation flow path includes the separation portion of the tube passage, the separation opening, the separation cavity, the divider passage, and the drive cavity. The bypass flow path includes the bypass portion of the tube passage, the bypass opening, and the drive cavity. At the drive cavity, the rotor shell has defined therein at least one jet nozzle, which is constructed and arranged to rotate the rotor shell by discharging from the drive cavity the fluid from the separation flow path and the bypass flow path.

A centrifuge according to another embodiment includes a rotor shaft that has a single fluid supply passage that supplies fluid to the centrifuge. The shaft defines one or more separation ports that are in fluid communication with the fluid supply passage. The shaft defines one or more bypass ports that are in fluid communication with the fluid supply passage. A tube is provided around the shaft, and the tube along with the shaft defines a tube passage. A baffle is positioned in the tube passage between the bypass ports and the separation ports. The baffle divides the tube passage into a bypass portion that is in fluid communication with the bypass port and a separation portion that is in fluid communication with the separation port. The baffle is constructed and arranged to minimize fluid leakage between the bypass portion and the separation portion. A rotor shell defines an inner cavity in which the tube is positioned. A divider plate is provided around the tube, and the divider plate divides the inner cavity into a drive cavity and a separation cavity. The divider plate defines a divider passage between the separation cavity and the drive cavity. The tube defines a separation opening between the separation portion of the tube passage and the separation cavity. The tube defines a bypass opening between the bypass portion of the tube passage and the drive cavity. The rotor shell defines a jet nozzle at the drive cavity, and the jet nozzle is constructed and arranged to rotate the rotor shell by discharging fluid from the drive cavity.

DESCRIPTION OF THE PREFERRED EMBODIMENTS

Figure 1:
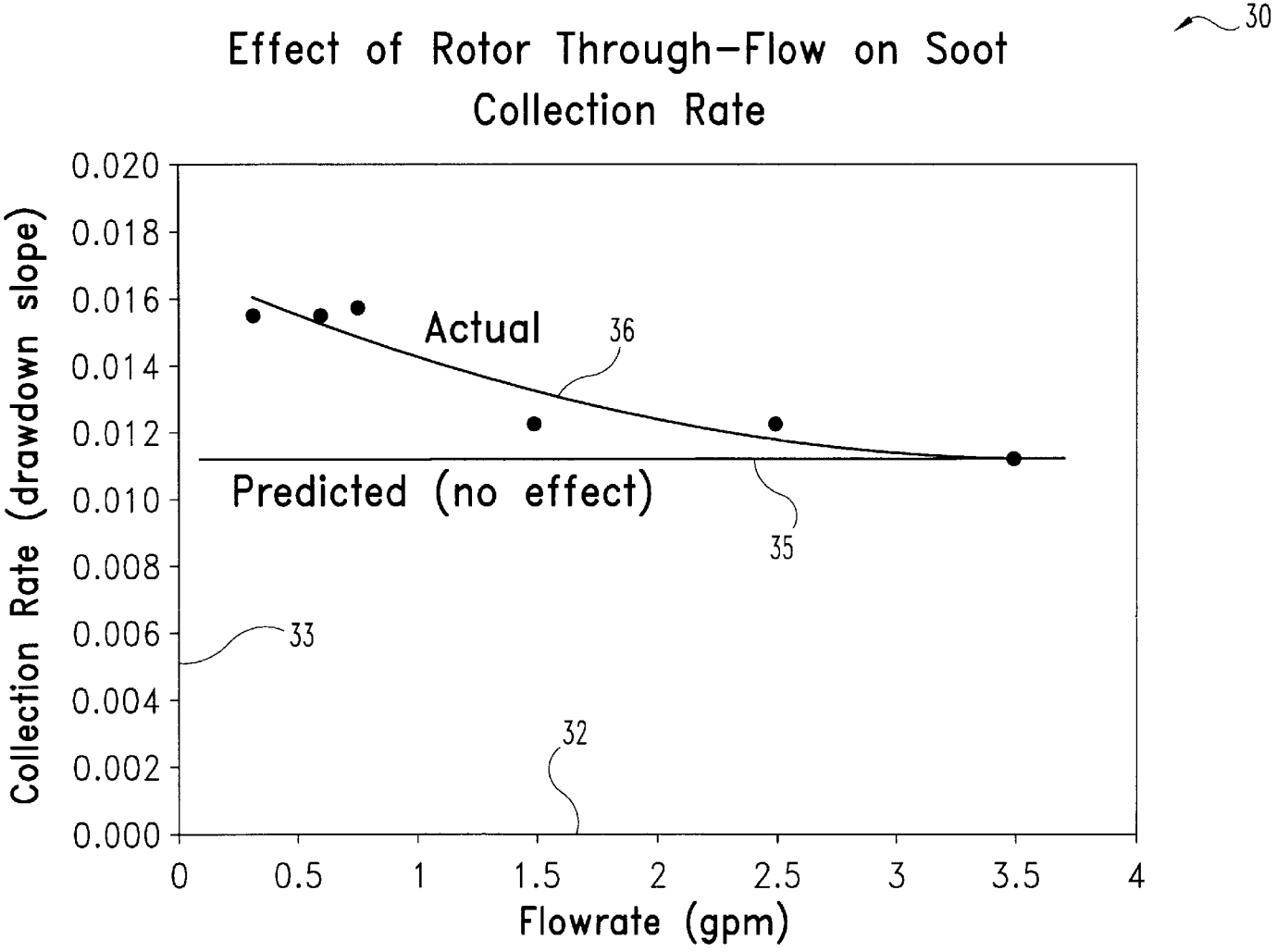
FIG. 1 is a graph illustrating the effect of rotor flow rate on collection rates for super-fine particles.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it should be apparent to those skilled in the art that some of the features which are not relevant to the invention may not be shown for the sake of clarity.

The fluid flow in a "free-jet" hero-turbine centrifuge rotor according to the present invention, which is either a "take apart" or a "disposable" design style, is modified to reduce the volumetric flow rate passing through the particulate collection zone (at which sludge, soot and other particulates are collected) without penalizing the rotor speed. The present invention accomplishes this by dividing the flow rate into two separate flow paths at the entrance of the rotor or after entering the rotor. The flow can be split at the entrance, for example, by utilizing two holes drilled in the rotor shaft that are separated by a baffle. The fluid can be split after entering the rotor by employing a seal between the shaft and the centrifuge hub, for example. In this "split-flow" centrifuge configuration, approximately 70% of the flow rate can be bypassed to the drive jets, while approximately 30% of the flow can be routed through the sludge collection zone in one embodiment. In other embodiments, this flow split (bypass flow rate to separation flow rate) can range anywhere from about a 1:1 ratio to about a 10:1 ratio. In the 1:1 flow split ratio, 50% of the fluid flow bypasses the sludge collection zone and 50% of the fluid flows through the sludge collection zone. In the 10:1 flow split ratio, approximately 90% of the fluid flow bypasses the sludge collection zone, while only 10% of the fluid flows through the sludge collection zone.

Reducing flow rate in the sludge collection zone improves the collection and especially the retention of super-fine particulates, such as soot, that is dispersed in a fluid. It should be noted, however, that this improvement in collection rate of super-fine particulates will come at the cost of decreased collection rate of larger particulates that are approximately greater than 3 microns in size. This is caused by the "100% efficiency constraint". The collection efficiency of the larger particulates cannot be increased beyond 100%. Therefore, decreasing the rotor flow rate results in reduced collection rate for the larger particulates due to the reduced through-put along with a single pass efficiency that cannot be above 100%.

The present invention described below attempts to extend the benefits of low rotor flow rate to the lower cost hero-turbine style centrifuges. In this type of centrifuge, all of the flow passing into the rotor is jetted out the turbine driving nozzles to achieve the highest possible rotational speed. Achieving this reduced through flow rate without reducing rotor speed requires a novel and non-obvious internal split path rotor flow in which some of the fluid flow passes through the sludge collection zone of the rotor while the larger portion of the fluid passes directly to the drive jets.

As described in more detail below, this can be achieved by using two general methods, a pre-rotor split method and a post-rotor split method. In the pre-rotor split method, two separate radially drilled ports are formed in the shaft and a ring shaped baffle is provided on the centrifuge hub between the two ports to ensure that fluid from each of the ports stays in the correct flow path. One of the fluid paths passes through the sludge collection zone before being discharged out drive jets and the other fluid path passes directly to the drive jets. In the post-rotor split method, a number of different techniques can be used to create separate flow paths in the rotor. In one technique, a baffle is used to control the rotor through flow rate such that the desired flow split between the collection zone and driving flow rate is achieved. In one form, a clearance space is formed between a drive shaft and an inwardly projecting ring shaped baffle so as to control the flow rate to the sludge collection zone. In another form, axial flow notches are molded into a lower end of the hub. The ratio between the areas of the two notches and clearance space can be adjusted to achieve the desired flow split. In an alternate approach, the opening sizes of orifices along each flow path are proportionally sized to achieve the desired flow rate.

Figure 2:
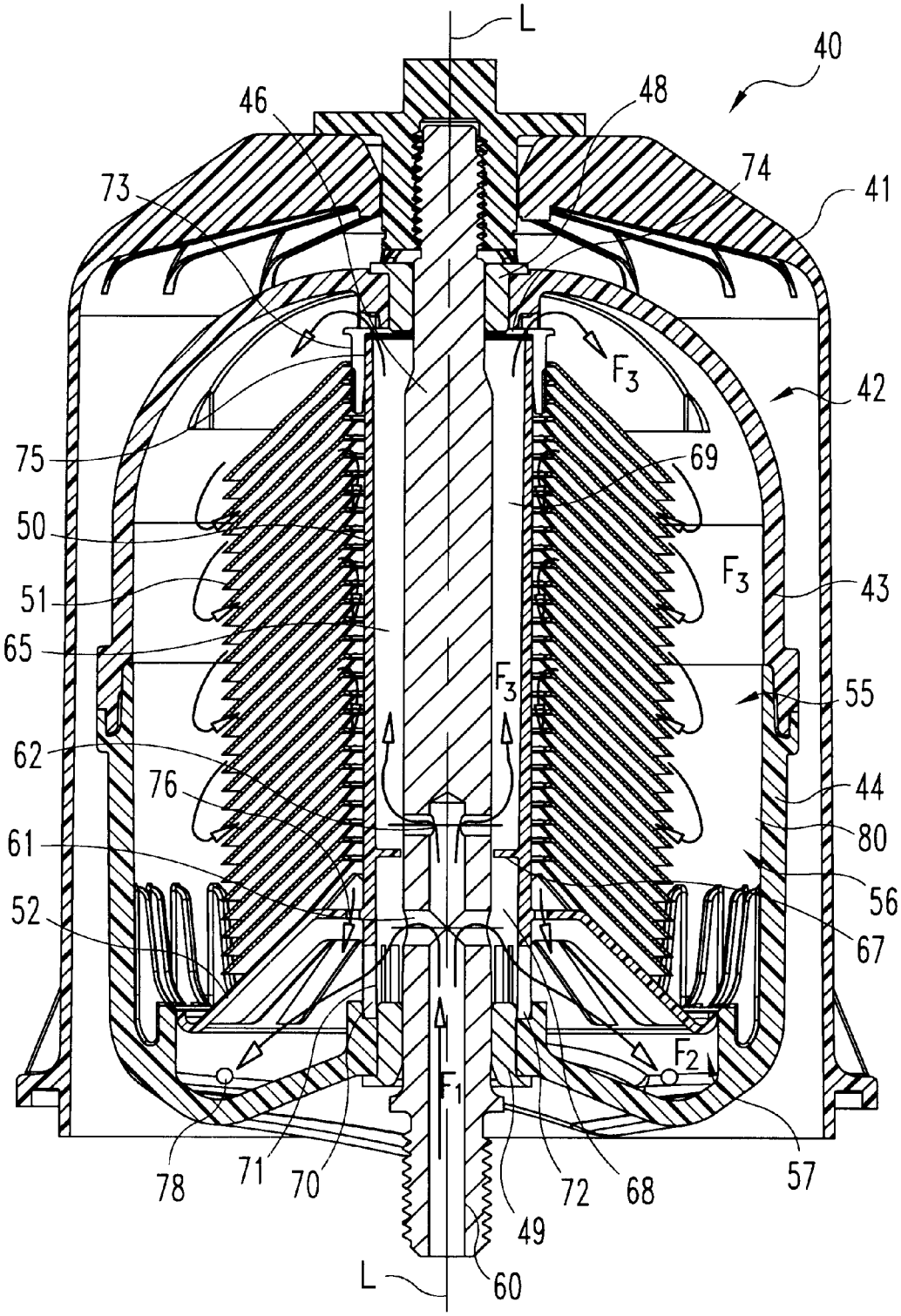
FIG. 2 is a front elevational view in full section of a self-driven centrifuge according to one embodiment of the present invention.

Referring to FIG. 2, there is illustrated a centrifuge 40 according to one embodiment of the present invention. Centrifuge 40 includes as some of its primary components a bell housing 41, rotor assembly 42 that includes upper 43 and lower 44 rotor shells, a rotor shaft 46, an upper bearing 48, a lower bearing 49, a center tube (hub) 50, a cone stack assembly 51, and a bottom divider plate 52.

Upper bearing 48 and lower bearing 49 are respectively used to rotationally mount the upper rotor shell 43 and lower rotor shell 44 to the shaft 46. The upper rotor shell 43 and lower rotor shell 44 together define an inner cavity 55. The bottom divider plate 52 subdivides cavity 55 into a sludge or particulate collection cavity portion (zone) 56 and a fluid discharge (drive) cavity portion 57. In the illustrated embodiment, the sludge collection portion 56 has the cone stack 51 contained therein. Although the present invention will be described for use with cone stack assemblies, it should be appreciated that the present invention can be adapted for use in other types of centrifuges, such as conventional or spiral vane types.

In the illustrated embodiment, the rotor shaft 46 is continuous and extends between the upper bearing 48 and the lower bearing 49. As should be appreciated that instead of being continuous, the rotor shaft 46 can be discontinuous so as to include two separate shaft portions. In this discontinuous form, an open space is defined between the shaft portions such that one of the shaft portions supports the upper bearing 48 and the other supports the lower bearing 49. In the illustrated embodiment, the rotor shaft 46 has a single fluid supply passage 60 defined therein for supplying fluid to the centrifuge 40. As shown in FIG. 2, the shaft 46 further has a pair of lower bypass ports 61 and a pair of upper fluid supply (separation) ports 62, both pairs of which are in fluid communication with the fluid supply passage 60. With each port pair, the ports 61, 62 for each pair are radially disposed at 90 degrees with respect to one another around longitudinal axis L of the shaft 46. It should be appreciated, however, that the supply ports 61, 62 can be oriented at other angles relative to longitudinal axis L of the shaft 46. Both the shaft 46 and center tube 50 define a center tube cavity 65. Inside cavity 65, the center tube 50 has an integrally formed seal ring baffle 67 positioned between bypass ports 61 and supply ports 62. It should be appreciated that, in an alternate form, the seal ring baffle 67 can instead be a separate component or attached to the shaft 46. The seal ring baffle 67 subdivides the center tube cavity 65 into a bypass cavity portion 68 and a separation cavity portion 69. At one end 70 of the center tube 50 proximal to the bypass cavity portion 68, the center tube 50 has a plurality of axial notches 71 defined therein. As should be understood, differently shaped or other types of openings besides the axial notches 71 can be defined in the center tube 50. As shown, the notched end 70 of tube 50 is received in an annular cavity 72 formed in the lower rotor shell 44. The cone stack assembly 51 has an end cap or spool 73 with a plurality of radially disposed separation openings 74 defined therein. Spool 73 is received around the other end 74 of the center tube 50. The divider plate 52 has a plurality of divider plate passages 76 defined around the center tube 50 so as to provide a passageway between the two cavities 56, 57. In the illustrated embodiment, the divider plate 52 is integrally formed with the center tube 50. It should be appreciated that instead having an integral divider plate 52 with a plurality of divider passages 76, a gap can be formed between the divider plate 52 and the center tube 50 so as to form an annular passageway. As illustrated in FIG. 2, the lower rotor shell 44 has jet flow orifices (nozzles) 78 defined therein. The jet flow orifices 78 are used to drive the centrifuge 40.

During operation, fluid, such as oil, is supplied by fluid supply passage 60 to the centrifuge 40, which is indicated by flow path F1. The fluid is then split into two distinct flow paths, bypass flow path F2 and separation flow path F3. As shown, fluid travelling along bypass flow path F2 is discharged from bypass ports 61 into the bypass cavity portion 68 of the center tube 50. The fluid travelling along bypass flow path F2 then travels through notches 71 into drive cavity 57 and is discharged from nozzles 78 to drive (rotate) the rotor assembly 42. The fluid travelling along separation flow path F3 has suspended particulates first removed before being discharged out nozzles 78. As depicted, fluid travelling along separation flow path F3 is discharged from supply ports 62 into fluid supply cavity portion 69. The seal ring baffle 67 seals cavity portion 68 from cavity portion 69 so as to minimize leakage of fluid between the flow paths F2 and F3. From fluid cavity supply portion 69, the fluid exits separation openings 74 into sludge collection cavity 56. The particulates settle against the inner walls 80 of the housing and are collected in the form of sludge. From the sludge collection cavity 56, the fluid is discharged out divider passages 76. This fluid from the separation flow path F3 along with the bypass fluid from the bypass flow path F2 is then discharged out jet flow orifices 78 in order to drive the rotor assembly 42 such that the rotor 42 can maintain an optimal rotational speed.

Figure 3:
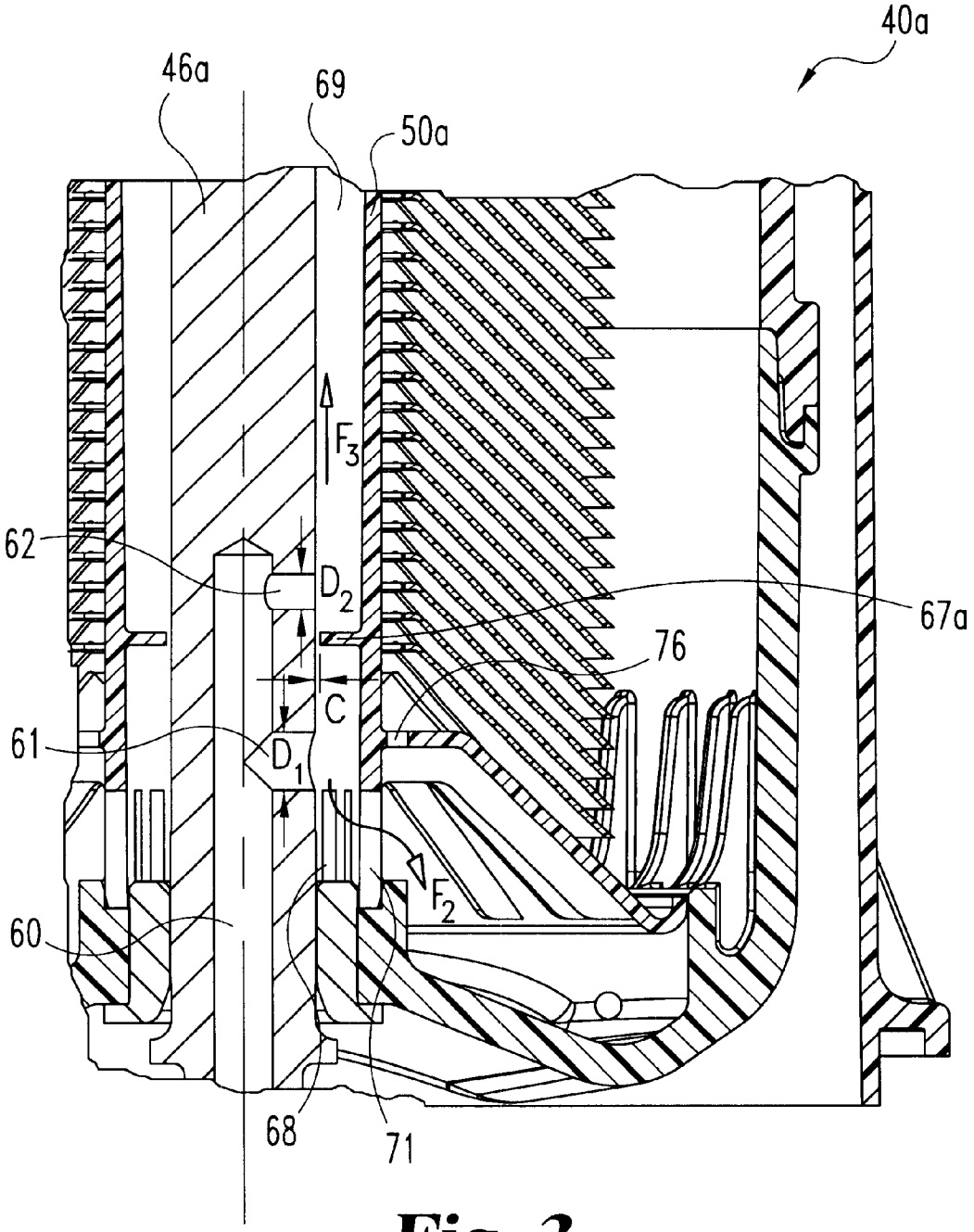
FIG. 3 is a partial, front elevational view in full section of a self-driven centrifuge according to another embodiment of the present invention.

A centrifuge 40*a* according to another embodiment of the present invention is illustrated in FIG. 3. Instead of the "full cross-drilled ports style" configuration as shown in the FIG. 2 embodiment, shaft 46*a* in this embodiment uses a single port design. As shown, instead of using pairs of ports 61 and 62, only a single port of each type is defined in the shaft 46*a*. The bypass port 61 has a diameter D1 and the supply port 62 has a diameter D2. For the illustrated embodiment, computational fluid dynamic analysis (CFD) modeling has shown in the case of the single port design of FIG. 3, a 3 mm supply port diameter D2 along with a 5 mm bypass port diameter D1 provides a desired 2:1 flow split ratio such that approximately 67% of the fluid bypasses the sludge collection zone cavity 56 and approximately 33% of the fluid flows through the sludge collection cavity 56. In the FIG. 2 embodiment that uses the full drill design ports to achieve a desired 2:1 flow split ratio, the diameter D2 of supply port 62 must be smaller, at 2.4 mm, due to a reduction in back pressure along with the inertial tendency of the fluid to keep moving upwards in passage 60. In both of these size configurations, pressure drop across either of the configurations is minimal (approximately less than 5 psid).

Figure 4:
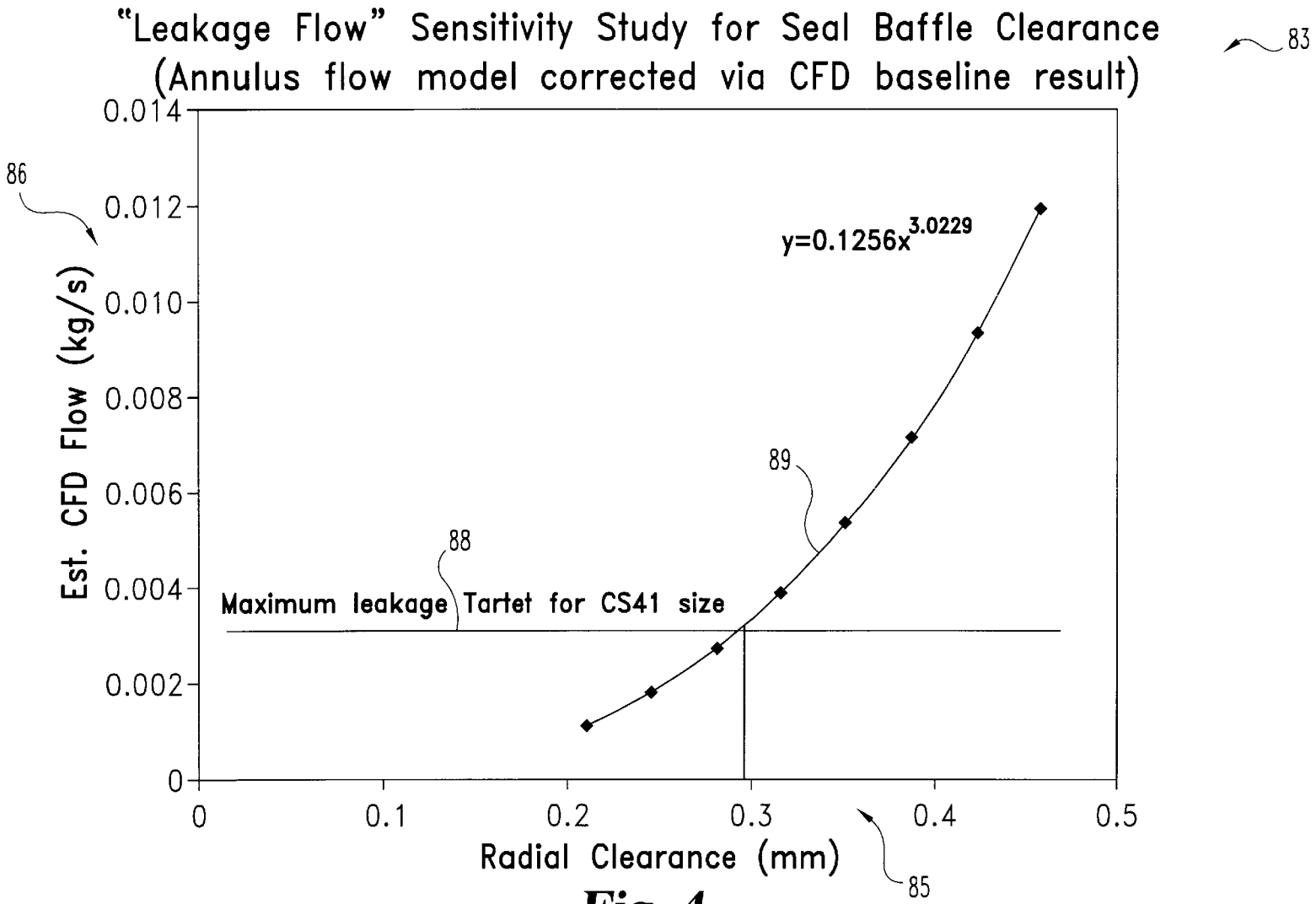
FIG. 4 is a graph illustrating the effect of baffle seal clearance on flow path leakage in the FIG. 3 centrifuge.

It was also discovered that radial clearance gap C (FIG. 3) between the baffle 67, 67*a* of the center tube 50, 50*a* and the shaft 46, 46*a* was critical in order to minimize cross leakage between the two flow paths F2, F3. It was found that a 0.5 mm clearance gap C between the baffle 67, 67*a* and the shaft 46, 46*a* created excessive leakage which negated the desired flow splits between flows F2 and F3. The 0.5 mm clearance C negated the desired flow split regardless on how the proportional sizes of the two ports 61 and 62 were adjusted. Further analysis showed that the radial seal ring clearance C should not exceed 0.3 mm in order to control leakage to a tolerable level. As shown in leakage study graph 83 in FIG. 4, the estimated leakage was calculated for differing radial clearances C. Graph 83 includes a radial clearance axis 85 and an estimated CFD leakage flow axis 86. The maximum target leakage of approximately 10% is shown by line 88 and the calculated values are shown by line 89. As depicted in the graph 83, the 0.3 mm clearance C keeps leakage to a tolerable level.

Figure 5:
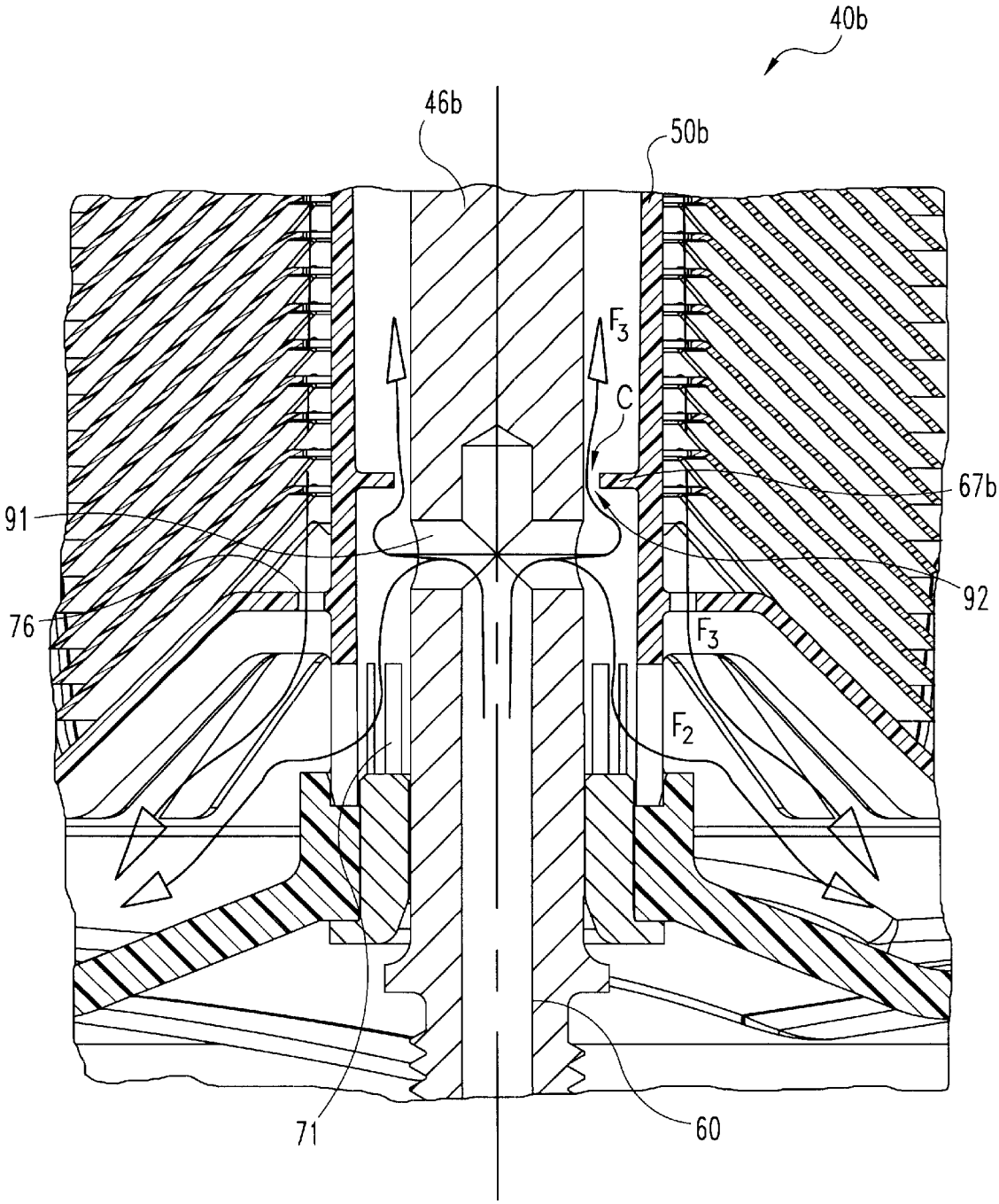
FIG. 5 is a partial, front elevational view in full section of a self-driven centrifuge with a single pair of fluid supply ports according to a further embodiment of the present invention.

A centrifuge 40*b* according to another embodiment of the present invention is illustrated in FIG. 5. As depicted, shaft 46*b* has a single pair of fluid supply ports 91 that supply fluid for both fluid path F2 and F3. The baffle seal ring 67*b* in this embodiment has clearance C from the shaft 46*b* so as to form an annular throttle passage 92. The clearance C between the seal ring 67*b* and shaft 46*b* is adjusted to throttle the fluid such that the desired flow split ratio is maintained. The baffle 67*b* is provided downstream from port 91 with respect to flow path F3 so as to control the amount of fluid flowing along flow path F3. As should be appreciated, in an alternate form a single port 91 can be provided in order to supply fluid to the centrifuge 40*b*. Alternatively, more than two fluid ports 91 can also be used to supply fluid to the centrifuge 40*b*.

Figure 6:
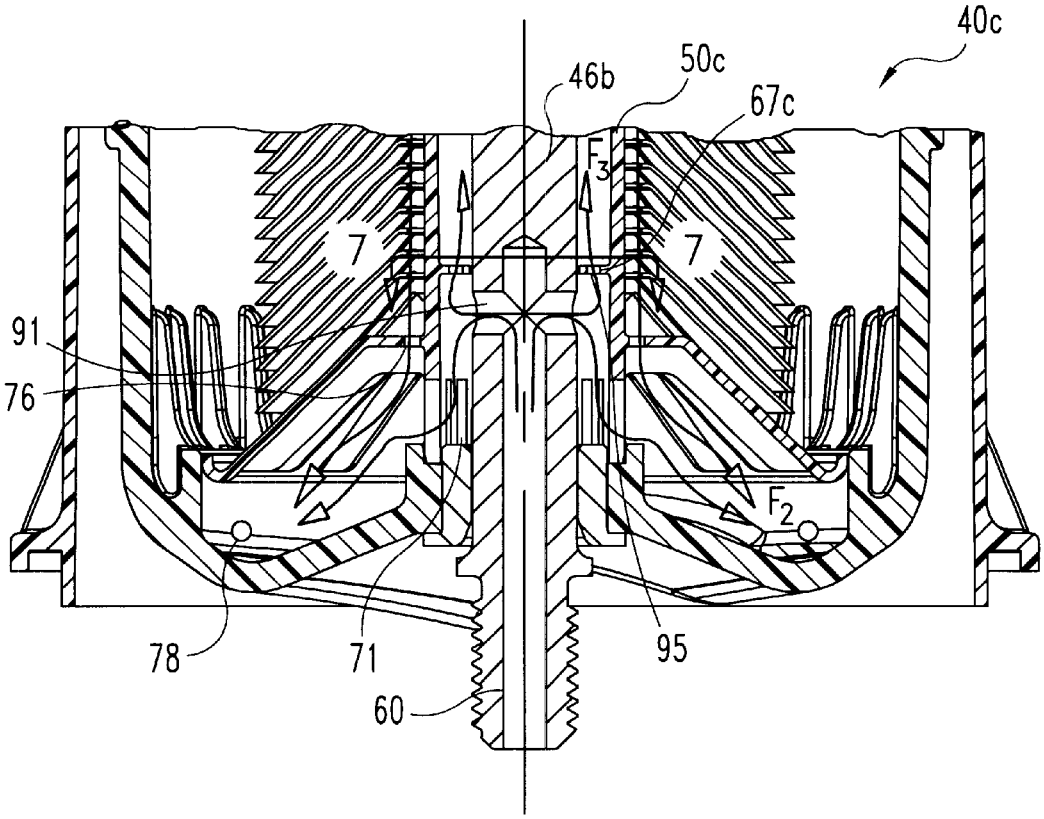
FIG. 6 is a partial, front elevational view in full section of a self-driven centrifuge with a modified baffle according to another embodiment of the present invention.
Figure 7:
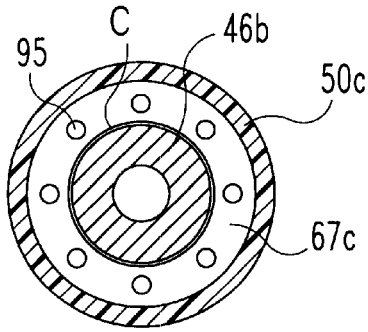
FIG. 7 is a partial, top-plan section view of the FIG. 6 centrifuge as viewed along line 7—7, with the cones, rotor shell and housing removed for added clarity.

A centrifuge 40*c* according to a further embodiment of the present invention is illustrated in FIGS. 6–7. As depicted in FIG. 6, the shaft 46*b* has a single pair of fluid ports 91 that supply fluid to the centrifuge 40*c*. As compared to the FIG. 5 centrifuge design 40*b* in which annular passage 92 was used to throttle fluid flow along separation flow path F3, center tube 50*c* in the FIG. 6 embodiment has a baffle 67*c* with a plurality of radially disposed flow openings 95 through which the fluid travels along flow path F3. FIG. 7 illustrates a cross-sectional view of the centrifuge 40*c*, but only shows the center tube 50*c*, shaft 46*b* and baffle 67*c* for the sake of clarity. As shown, flow openings 95 are radially disposed about the shaft 46*b*. The gap C between the shaft 46*b* and baffle 67*c* is minimized such that the fluid predominantly flows through openings 95. The number, size, and shape of openings 95 can be adjusted in order to provide the desired flow split ratio.

Figure 8:
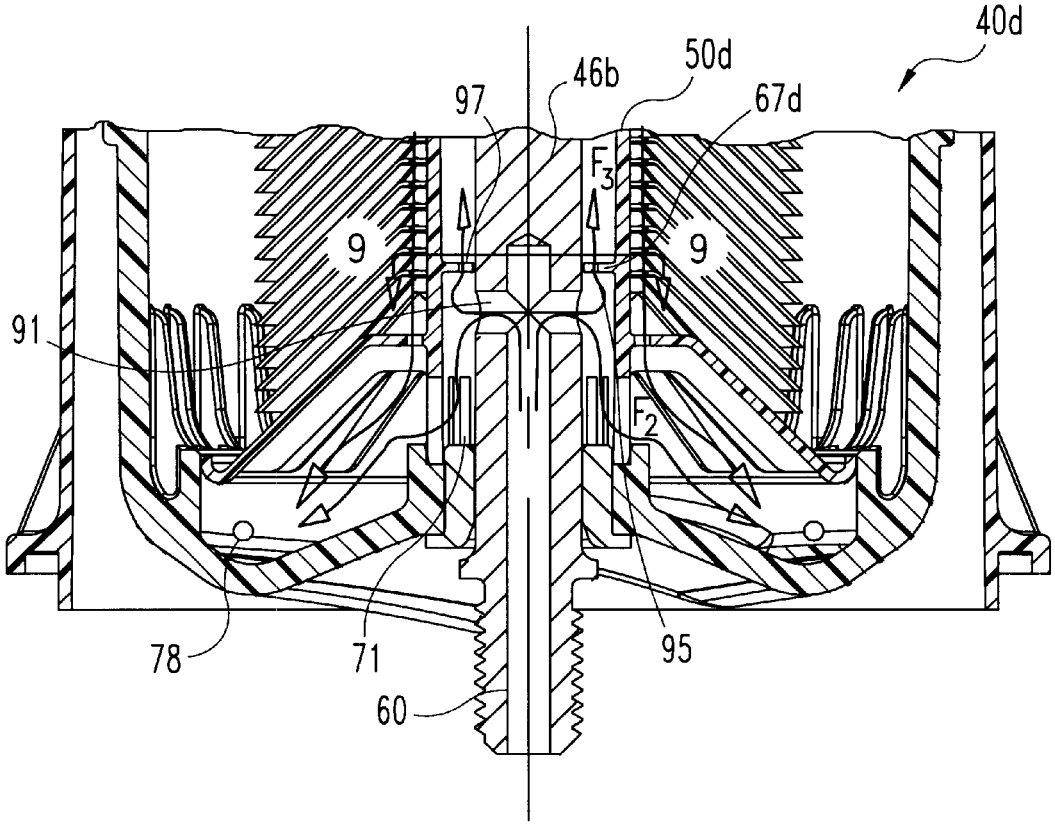
FIG. 8 is a partial, front elevational view in full section of a self-driven centrifuge with a serrated baffle according to another embodiment of the present invention.
Figure 9:
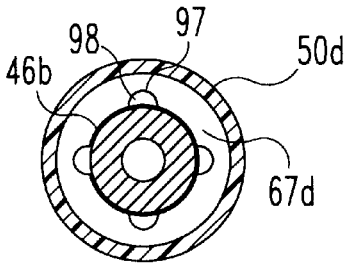
FIG. 9 is a partial, top-plan section view of the FIG. 8 centrifuge as viewed along line 9—9, with the cones, rotor shell and housing removed for added clarity.

A centrifuge 40*d* according to still yet another embodiment of the present invention is illustrated in FIGS. 8–9. As depicted in FIG. 8, centrifuge 40*d* includes shaft 46*b* positioned inside center tube 50*d*. As shown in greater detail in FIG. 9, the center tube 50*d* has a seal ring baffle 67*d* that includes a plurality of radially disposed serrations 97. The shaft 46*b* and the serrations 97 define flow openings 98 for fluid flow path F3. As illustrated in FIG. 9, the serrations 97 are radially disposed around the shaft 46*b*. The serrations 97 are sized and configured to provide the desired flow split ratio in the centrifuge 40*d*, such as from a 1:1 to 10:1 ratio.

Figure 10:
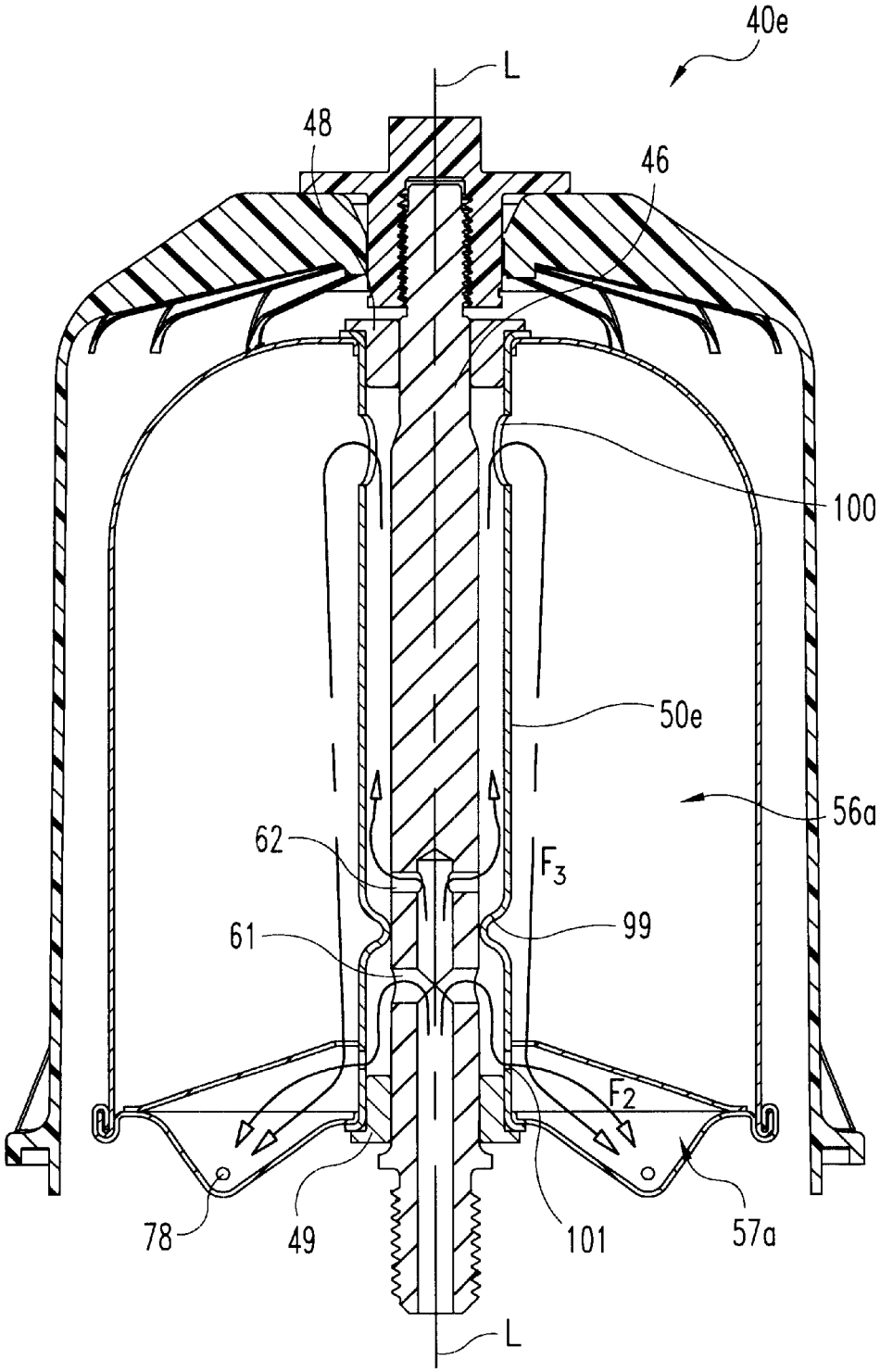
FIG. 10 is a front elevational view in full section of a self-driven centrifuge with a bent ridge baffle according to a further embodiment of the present invention.
Figure 11:
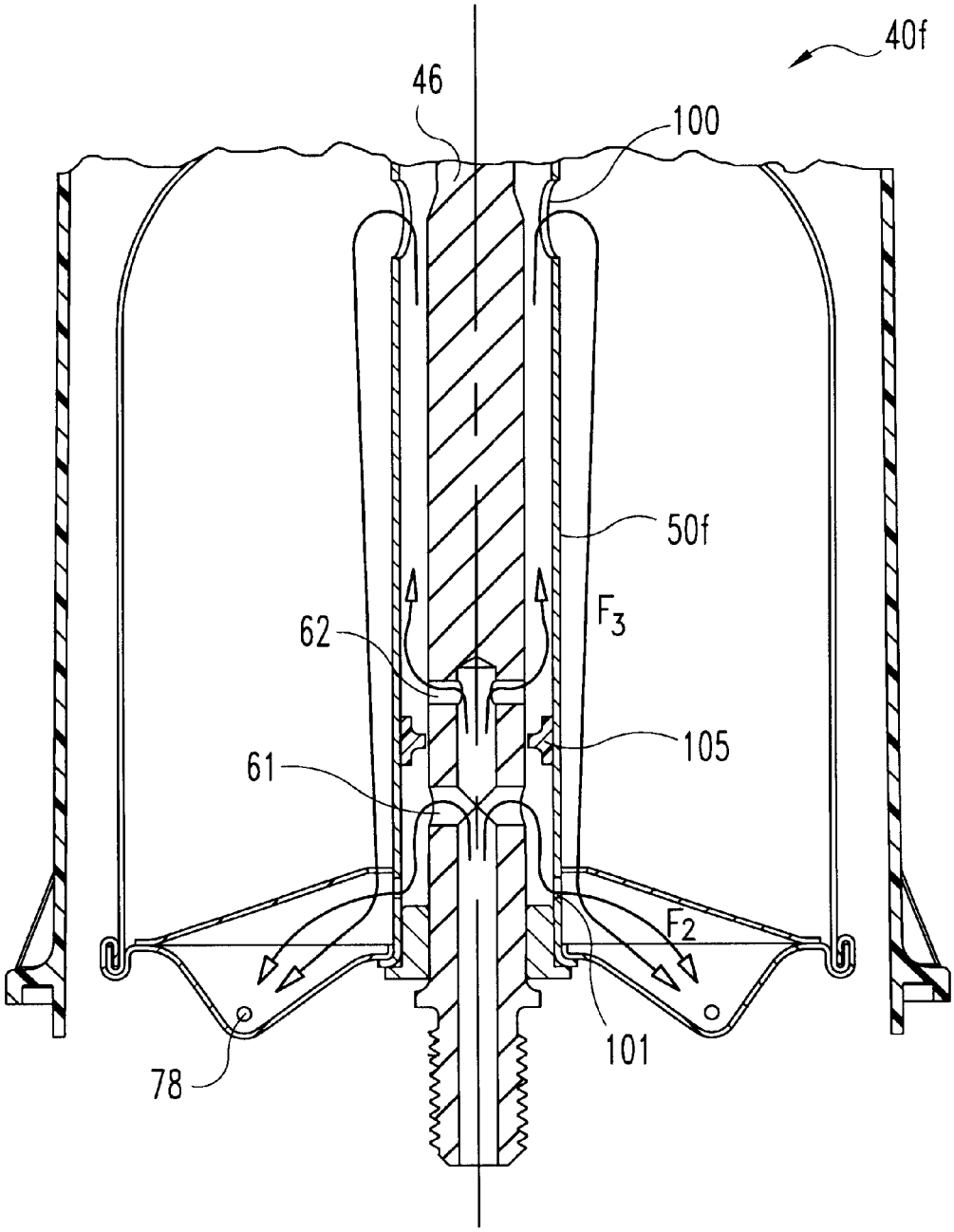
FIG. 11 is a partial, front elevational view in full section of a self-driven centrifuge with an elastic seal ring baffle according to another embodiment of the present invention.

It should be appreciated that "conventional" disposable rotor designs that do not incorporate efficiency enhancement devices, such as cone stacks or spiral vanes, and "take apart" rotor designs with metallic components that are designed to be cleaned and re-used instead of discarded can also incorporate the flow direction concepts according to the present invention. An example of one such modified centrifuge 40*e* is shown in FIG. 10. Centrifuge 40*e* includes a dual inlet shaft 46 that includes bypass 61 and separation 62 ports. The center tube 50*e* in the illustrated embodiment includes a formed (bent) ridge 99 that acts as a baffle to minimize leakage between the two flow paths F2, F3. An outlet opening 100 for flow path F3 is defined in the upper portion of the center tube 50*e*, which is proximal separation cavity 56*a*. A bypass opening 101 is defined in the lower portion of center tube 50*e*, proximal cavity 57*a* through which fluid can flow along bypass flow path F2. In another embodiment, which is shown in FIG. 11, an insertable, elastic seal ring 105 is placed inside center tube 50*e* between ports 61 and 62 so as to act as a baffle.

Figure 12:
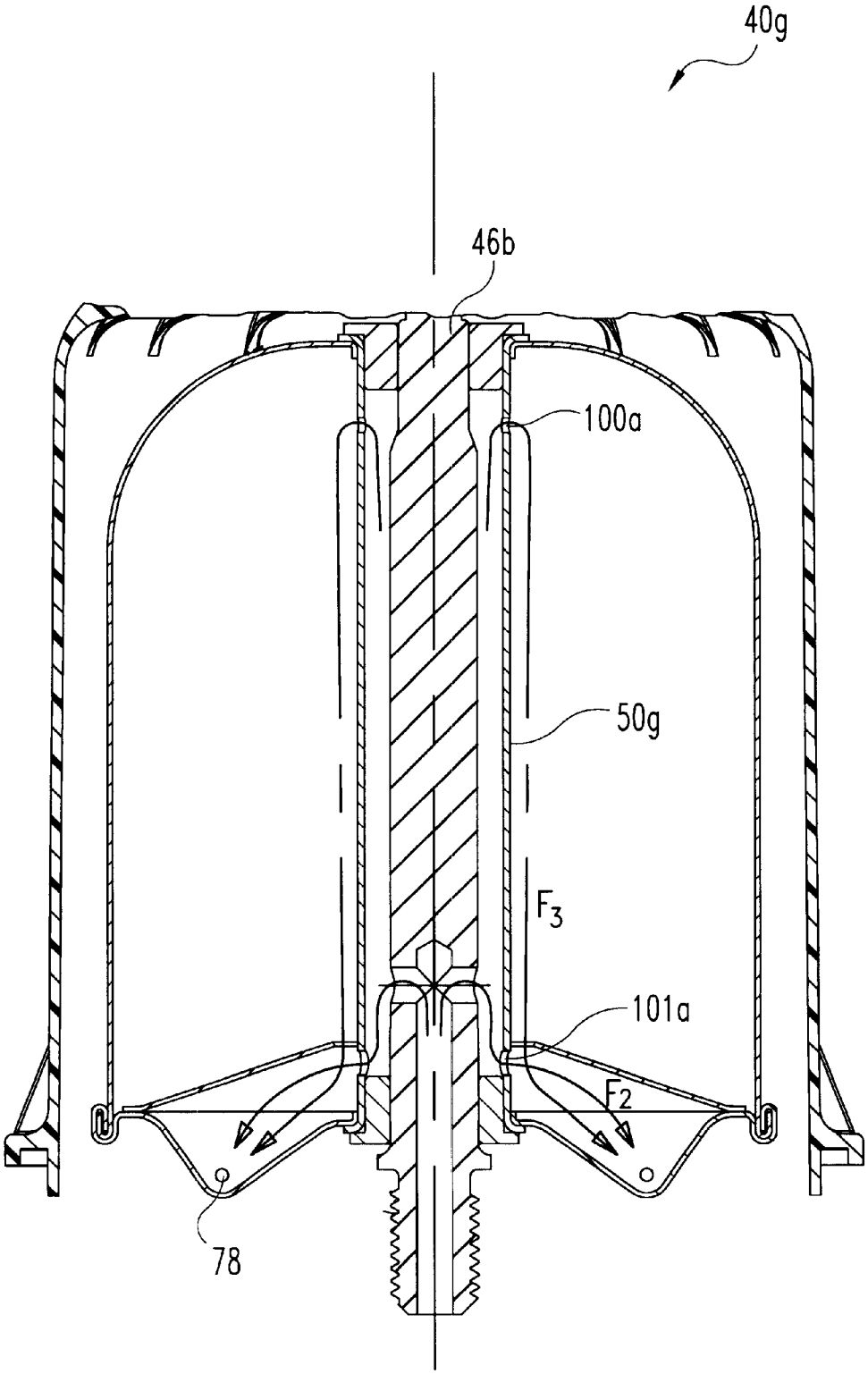
FIG. 12 is a partial, front elevational view in full section of a self driven centrifuge according to still yet another embodiment of the present invention.

In still yet another embodiment, as shown in FIG. 12, instead of using a baffle to direct flow in centrifuge 40*g*, the sizes of openings 100*a* and 101*a* in center tube 50*g* are adjusted to achieve the desired flow split. The openings 100*a* and 101*a* can be proportionally sized such that the desired fluid split ratios for the flow paths F2, F3 can be achieved. Assuming the pressure at openings 100*a* and 101*a* are the same, then the total size of each of the openings 100*a*, 101*a* will restrict flow proportionally to achieve the desired flow split ratio. For example, to have a desired 1:1 flow split ratio of flow, then the total size of each opening 100*a*, 101*a* should be the same. This concept can be used during the design phase to approximate the desired opening sizes required to achieve a desired flow split ratio. As the pressure differential between the openings 100*a*, 101*a* increases, such a design concept is less applicable, and modeling and/or testing must be used to determine the proportional sizing of the openings 100*a*, 101*a* in order to achieve the desired flow split ratio.

Figure 13:
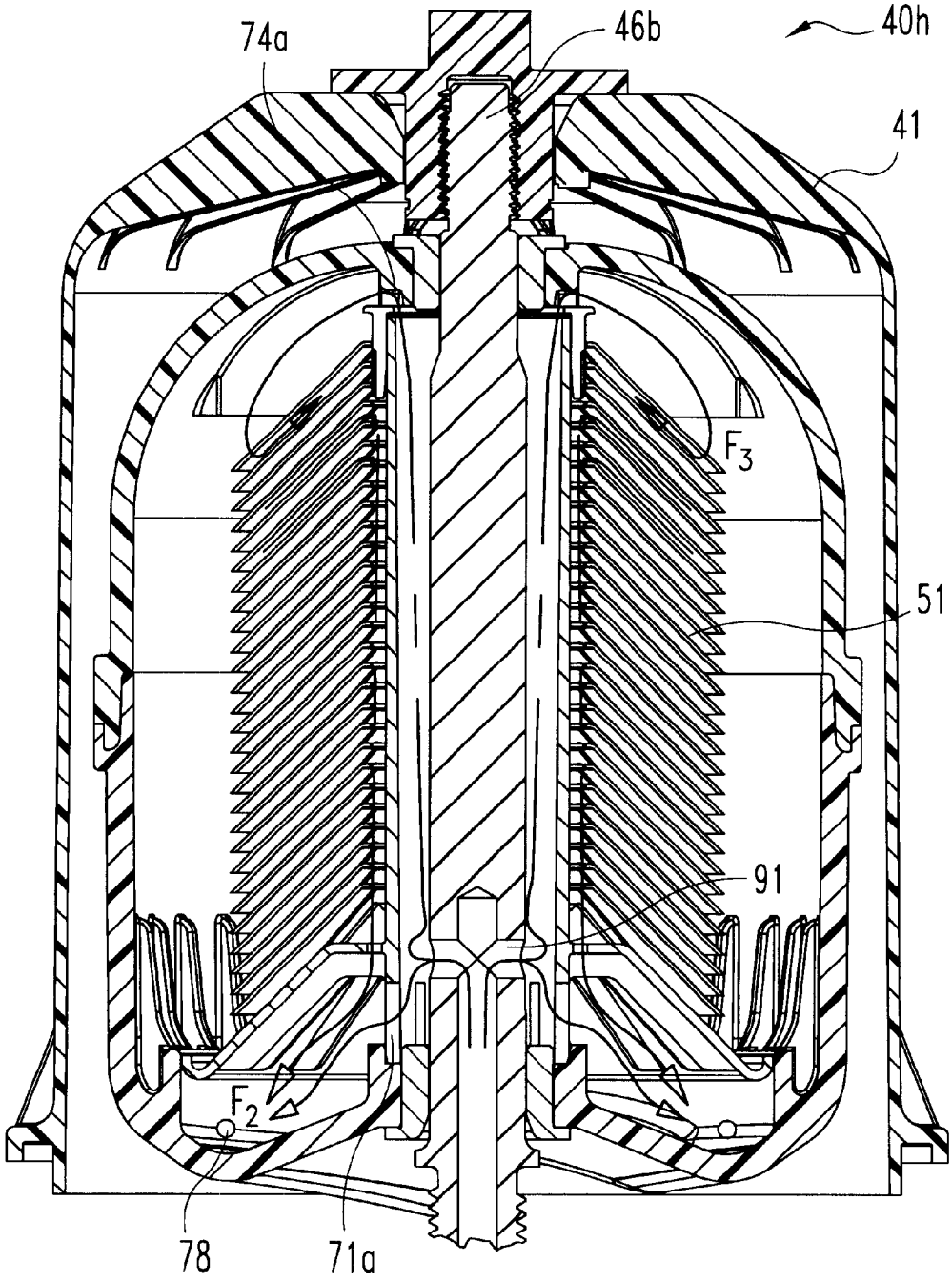
FIG. 13 is a front elevational view in full section of a self driven centrifuge according to a further embodiment of the present invention.

A centrifuge 40*h* according to another embodiment of the present invention is illustrated in FIG. 13. In this type of centrifuge, no modifications to the previously installed rotor shaft 46*b* needs to be made and minimal tooling changes need to be made to an existing disposable rotor design (Fleetguard CS41 series, which is now in production). In the illustrated embodiment, the sizes of openings 74*a* and 71*a* are adjusted in order to create the desired flow split ratio. As discussed above, properly sizing and numbering these openings can provide the proper choking of the flow passages so as to throttle the fluid flow in order to provide the desired flow split ratio.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge, comprising:

a rotor shell defining an inner cavity, said rotor shell defining a jet orifice to discharge fluid to rotate said rotor shell;

a divider for partitioning said inner cavity into a drive cavity and a separation cavity for collecting particulate matter from the fluid, said divider defining at least in part a divider passage between said separation cavity and said drive cavity, wherein said jet orifice opens into said drive cavity;

a tube having a fluid passage and being constructed and arranged to supply the fluid, said tube defining a separation opening at said separation cavity and a bypass opening at said drive cavity;

wherein said tube is constructed and arranged to deliver the fluid to said drive cavity through both a bypass flow path and a separation flow path;

wherein said bypass flow path includes said bypass opening;

wherein said separation flow path includes said separation opening, said separation cavity and said divider passage; and wherein said drive cavity is constructed and arranged to discharge the fluid received from both said bypass flow path and said separation flow path out said jet orifice.

2. The centrifuge of claim 1, wherein said tube includes an inwardly extending baffle constructed and arranged to separate said separation flow path from said bypass flow path.

3. The centrifuge of claim 2, further comprising a rotor shaft extending through said baffle.

4. The centrifuge of claim 3, wherein said shaft and said baffle define an annular gap through which the fluid for said separation flow path flows.

5. The centrifuge of claim 3, wherein said baffle has one or more serrations defined therein around said shaft through which the fluid for said separation flow path flows.

6. The centrifuge of claim 3, wherein:

said shaft has a supply passage, a bypass port and a separation port defined therein;

said supply passage is connected to said bypass and separation ports;

said bypass port is in fluid communication with said bypass flow path;

said separation port is in fluid communication with said separation flow path; and said baffle is positioned between said bypass port and said separation port to separate said bypass flow path from said separation flow path.

7. The centrifuge of claim 6, wherein said baffle and said shaft define a clearance gap that is less than 0.5 mm.

8. The centrifuge of claim 7, wherein said clearance gap is less than 0.3 mm.

9. The centrifuge of claim 2, wherein said baffle has one or more openings defined therein through which the fluid from said separation flow path flows.

10. The centrifuge of claim 2, wherein said baffle includes a bent ridge formed in said tube.

11. The centrifuge of claim 2, wherein said baffle includes a seal ring pressed into said tube.

12. The centrifuge of claim 1, wherein said bypass opening includes an axially disposed notch.

13. The centrifuge of claim 1, wherein said bypass opening and said separation opening are sized in proportion to flow rates in said bypass flow path and said separation flow path.

14. The centrifuge of claim 13, wherein said bypass opening is twice as large as said separation opening.

15. The centrifuge of claim 1, wherein said rotor shell includes an upper rotor shell portion and a lower rotor shell portion mated with said upper rotor shell portion.

16. The centrifuge of claim 1, further comprising a cone stack assembly provided in said separation cavity around said tube.

17. The centrifuge of claim 1, further comprising a shaft extending within said fluid passage of said tube, said shaft defining a supply passage constructed and arranged to deliver the fluid to said fluid passage.

18. The centrifuge of claim 17, wherein said shaft has one or more supply ports defined therein to supply the fluid from said supply passage to said fluid passage.

19. The centrifuge of claim 18, wherein:

said shaft extends along a longitudinal axis; and said supply ports include a pair oppositely disposed ports that are oriented perpendicular to said longitudinal axis.

20. The centrifuge of claim 17, wherein said shaft has defined therein one or more bypass ports to supply the fluid to said bypass flow path and one or more separation ports to supply the fluid to said separation flow path.

21. The centrifuge of claim 20, wherein said one or more bypass ports have an inner diameter of approximately 5 mm and said one or more separation ports have an inner diameter of approximately 3 mm.

22. The centrifuge of claim 20, wherein said one or more separation ports is a single port having an inner diameter of approximately 2.4 mm.

23. The centrifuge of claim 1, wherein said divider is integrally formed with said tube and said divider passage includes a plurality of a radially disposed openings around said tube.

24. The centrifuge of claim 1, wherein said separation opening is sized to restrict flow along said separation flow path.

25. The centrifuge of claim 1, wherein said bypass flow path and said separation flow path receive the fluid from a single source.

26. A centrifuge, comprising:

a shaft defining a single fluid passage to supply fluid to the centrifuge, wherein said shaft has one or more fluid ports defined therein that are in fluid communication with said fluid passage;

a tube provided around said shaft, said tube and said shaft defining a tube passage that is in fluid communication with said one or more fluid ports;

a rotor shell defining an inner cavity in which said tube is positioned;

a divider plate for partitioning said inner cavity into a drive cavity and a separation cavity, said divider plate defining a divider passage between said separation cavity and said drive cavity;

said tube defining a separation opening to communicate the fluid between said tube passage and said separation cavity;

said tube defining a bypass opening to communicate the fluid between said tube passage and said drive cavity;

a baffle positioned in said tube passage between said one or more fluid ports and said separation opening, said baffle dividing said tube passage into a separation portion and a bypass portion, wherein said baffle is constructed and arranged to separate a separation flow path of the fluid from a bypass flow path of the fluid;

said separation flow path including said separation portion of said tube passage, said separation opening, said separation cavity, said divider passage, and said drive cavity;

said bypass flow path including said bypass portion of said tube passage, said bypass opening, and said drive cavity; and said rotor shell defining a jet nozzle at said drive cavity, said jet nozzle being constructed and arranged to rotate said rotor shell by discharging from said drive cavity the fluid from said separation flow path and said bypass flow path.

27. The centrifuge of claim 26, wherein said baffle defines one or more separation openings through which the fluid for said separation flow path flows.

28. The centrifuge of claim 27, wherein said separation openings include one or more serrations defined in said baffle around said shaft.

29. The centrifuge of claim 26, wherein said baffle is integrally formed with said tube.

30. The centrifuge of claim 26, wherein said baffle includes a seal ring.

31. The centrifuge of claim 26, wherein said one or more fluid ports include a pair of ports positioned on opposite sides of said shaft.

32. The centrifuge of claim 26, further comprising:

one or more separation ports defined in said shaft to supply the fluid to said separation flow path;

said one or more fluid ports being constructed and arranged to supply fluid to said bypass flow path; and said baffle being positioned between said one or more fluid ports and said one or more separation ports to minimize fluid leakage between said bypass flow path and said separation flow path.

33. The centrifuge of claim 26, wherein said drive cavity is constructed and arranged to mix and discharge together the fluid from said separation flow path and said bypass flow path out said jet nozzle.

34. A centrifuge, comprising:

a rotor shaft defining a single fluid supply passage to supply fluid to the centrifuge, said shaft defining one or more separation ports that are in fluid communication with said fluid supply passage, said shaft defining one or more bypass ports that are in fluid communication with said fluid supply passage;

a tube provided around said shaft, said tube and said shaft defining a tube passage;

a baffle positioned in said tube passage between said one or more bypass ports and said one or more separation ports, said baffle dividing said tube passage into a bypass portion that is in fluid communication with said one or more bypass ports and a separation portion that is in fluid communication with said one or more separation ports, wherein said baffle is constructed and arranged to minimize fluid leakage between said bypass portion and said separation portion;

a rotor shell defining an inner cavity in which said tube is positioned;

a divider plate for partitioning said inner cavity into a drive cavity and a separation cavity, said divider plate defining a divider passage between said separation cavity and said drive cavity;

said tube defining a separation opening between said separation portion of said tube passage and said separation cavity;

said tube defining a bypass opening between said bypass portion of said tube passage and said drive cavity; and said rotor shell defining a jet nozzle at said drive cavity, said jet nozzle being constructed and arranged to rotate said rotor shell by discharging fluid from said drive cavity.

* * * * *